United States Patent [19]

Buckwalter

[11] 4,241,464

[45] Dec. 30, 1980

[54] FLUID JET DEVICE

[76] Inventor: Nevin Buckwalter, 11313 N. Rome Ave., Tampa, Fla. 33612

[21] Appl. No.: 53,350

[22] Filed: Jun. 29, 1979

[51] Int. Cl.[3] ..... E04H 3/16; E04H 3/18

[52] U.S. Cl. ..... 239/251; 4/492; 128/66; 134/167 R; 210/169

[58] Field of Search ..... 4/172.15, 172.17, 178, 4/180, 172; 128/66; 134/167 R, 168; 210/169; 239/192

[56] References Cited

U.S. PATENT DOCUMENTS

| | | | |
|---|---|---|---|
| 3,045,829 | 7/1962 | Rule et al. | 4/172.17 X |
| 3,392,738 | 7/1968 | Pansini | 4/172.17 X |
| 3,506,489 | 4/1970 | Baker | 4/172 X |
| 3,577,571 | 5/1971 | Bellinsoni | 4/172.17 |
| 3,628,529 | 12/1971 | Steimle | 4/180 X |
| 3,675,252 | 7/1972 | Ghiz | 4/172.17 |
| 3,749,424 | 7/1973 | Greene | 4/172 X |
| 3,820,173 | 6/1974 | Weller | 4/178 X |
| 3,829,911 | 8/1974 | Bishop | 4/172.17 |
| 3,890,655 | 6/1975 | Mathis | 4/178 |
| 3,946,449 | 3/1976 | Mathis | 4/178 |

*Primary Examiner*—Henry K. Artis
*Attorney, Agent, or Firm*—Arthur W. Fisher, III

[57] ABSTRACT

A fluid jet device for removing foreign matter from a pool of liquid comprising a hollow substantially cylindrical housing including a housing channel formed therein, an elongated rotatably member including a convoluted spiral formed on the outer surface thereof disposed within the housing channel and a coupling device to rotatably mount the elongated rotatably member to permit fluid to pass rapidly through the convoluted spiral to cause a rotation of the elongated member continuously changing the direction of the fluid exiting the fluid jet device.

3 Claims, 7 Drawing Figures

FLUID JET DEVICE

BACKGROUND OF THE INVENTION

1. Field of the Invention

A fluid jet device for removing foreign matter from a pool of liquid.

2. Description of Prior Art

With the introduction of swimming pools, various self-cleaning devices and techniques have been developed. One approach for proper cleaning of the water employs circulating and filtering the water drawn over a skimming and into a skim tank. Floating debris passes out of the pool and is collected in a filter like arrangement. Due to evaporation and splashing, the level of water in a pool is not maintained constant. In order to maintain proper flow from the surface of the pool to the filter despite changes of height of the water in the pool where floating wiers have been used.

In such arrangements, the water passing over the skimming weir is received in the tank, which supplies the inlet of a pump which does the recirculating. The floating weir is pivoted on a horizontal axis, and is responsive to the level of water in the tank, and it operates to keep the level constant for any given flow rate determined by the pump. The weir performs this function over an ordinary range of variation of pool water level.

Another technique includes a plurality of spored nozzles disposed in the opposite side walls of the pool for injecting streams of conically-shaped inoculum carrying liquid into the pool to create turbulent mixing regions. Still another example comprises a plurality of rotating jet delivery means adapted to deliver jet streams of water substantially parallel to and in adjacent relation with the inner surface of the pool for washing and cleansing the inner surface.

Prior art examples are found in U.S. Pat. Nos. 2,073,784; 2,088,410; 2,739,939; 3,018,491; 3,090,489; 3,261,371; 3,289,216; 3,778,023; 3,315,692; 3,392,738; 3,432,867; 3,577,571; 3,608,131; 3,675,252; 3,797,508; 3,829,911.

SUMMARY OF THE INVENTION

The present invention relates to a fluid jet device for removing foreign matter from a pool of liquid. More specifically the fluid jet device comprises an outer housing having an elongated rotating means rotatably disposed therein by a coupling means.

The outer housing comprises an elongated hollow member having a centrally disposed channel extending the entire longitudinal dimension thereof. The elongated rotating means comprises a substantially cylindrical member having at least one convoluted spiral formed the entire length thereof. The housing is operatively coupled to the coupling or rotary means such as a bearing attached to the wall of a swimming pool or the like. The inner portion of the hollow member comprises an inlet while the outer portion comprises an outlet to provide rapid rotation as fluid is forced through the spiral channel. The outlet may comprise a plurality of outlet ports.

In use the fluid jet device is coupled to a water source to receive water under pressure through the inlet. Normally the fluid jet device is secured near the bottom of a swimming pool to sweep the bottom to clean dirt and debris through the force of water exiting from the outlet. Pressure of the fluid passing through the spiral causes rotation of the device.

Although the fluid jet device is depicted as a cleaning means for a swimming pool, it is envisioned to also function as a sprinkler or fountain.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
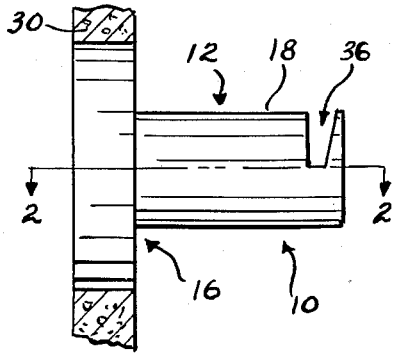
FIG. 1 is a side view of the fluid jet device.
Figure 2:
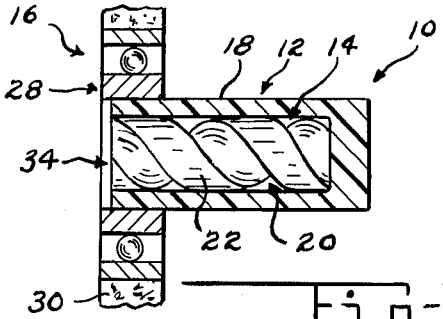
FIG. 2 is a cross sectional side view of the fluid jet device taken along line 2—2 of FIG. 1.
Figure 3:
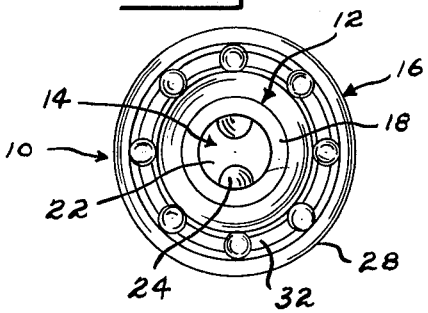
FIG. 3 is a top view of the fluid jet device.
Figure 4:
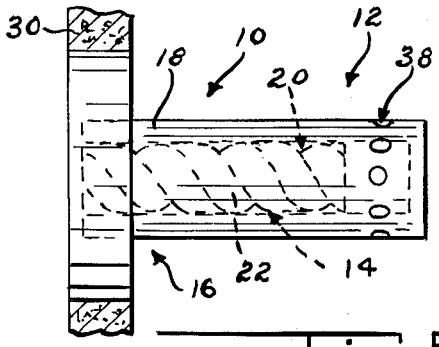
FIG. 4 is a side view of an alternate embodiment of the fluid jet device.

As shown in FIGS. 1 through 3, the fluid jet device generally indicated as 10 for removing foreign matter from a pool of liquid comprises an outer housing generally indicated as 12 having an elongated rotating means 14 rotatably disposed therein by a coupling means generally indicated as 16.

As shown, the outer housing 12 comprises an elongated substantially cylindrical hollow member 18 having a centrally disposed channel 20 extending the entire longitudinal dimension thereof. The elongated rotating means 14 comprises a substantially cylindrical member 22 having at least one convoluted spiral 24 formed entire length thereof. The inner portion of the housing 12 is operatively coupled to the coupling means 16 which comprises rotary means 26. The rotary means 26 such as a bearing includes an outer portion 28 attached to the wall of a swimming pool 30 or the like and an inner portion 32 rotatably mounted thereon to which the inner portion of the hollow member 18 is fixedly attached. The inner portion of the hollow member 18 comprises an inlet 34 while the outer portion comprises an outlet 36 (the axis of the outlet 36 offset relative to the longitudinal axis of the fluid jet device 10 to provide rapid rotation as fluid is forced through the spiral channel 24 as more fully described hereinafter).

In use the fluid jet device 10 is coupled to a water source (not shown) to receive water under pressure through the inlet 24. Normally the fluid jet device 10 is secured near the bottom of a swimming pool (not shown) to sweep the bottom to clean dirt and debris through the force of water exiting from the outlet 36. Pressure of the fluid passing through the spiral 24 causes rotation of the device 10 at any given speed depending upon the size and shape of the spiral 24, the amount of friction caused by indentation or other markings on the spiral 24 and the amount of the pressure of liquid passing through the spiral 24.

FIG. 3 shows an alternate embodiment wherein the outlet 36 comprises a plurality of outlet ports 38 formed in the hollow member 18.

Figure 5:
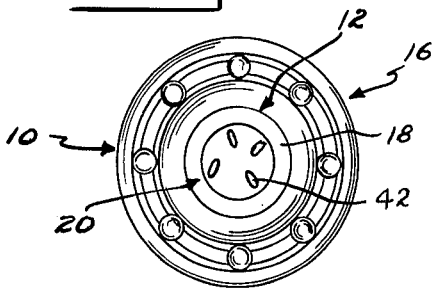
FIG. 5 is a top view of still another alternate embodiment of the fluid jet device.
Figure 6:
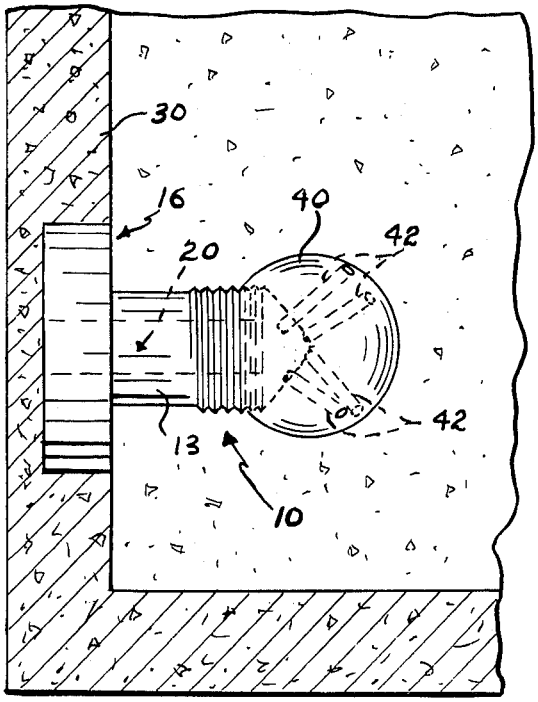
FIG. 6 is a side view of the alternate embodiment of the fluid jet device of FIG. 6.
Figure 7:
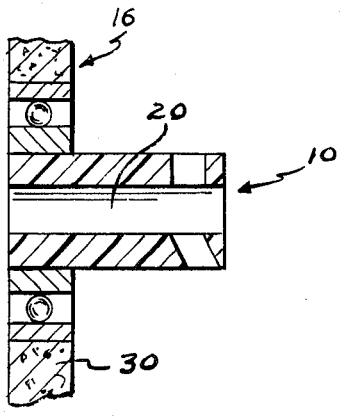
FIG. 7 is a side view of still another alternate embodiment of the fluid jet device.

An alternate embodiment as best shown in FIGS. 5 and 6 may comprise a hollow member 18 having a spray head 40 mounted on the outer end thereof including at least one channel 42 offset relative to the longitudinal dimension of the substantially cylindrical hollow member 18. The device 10 may be configured to operate with a channel 42 formed on the periphery of the hollow member 18 as shown in FIG. 7.

Although the fluid jet device 10 is depicted as a cleaning means for a swimming pool, it is envisioned to also function as sprinkler or fountain.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A fluid jet device comprising an outer housing having a centrally disposed housing channel formed therein and an elongated rotatable member operatively disposed within said housing channel in combination with a coupling means to rotatably support said elongated rotatable member, said coupling means comprises a rotating means including a first and second member, said first member being attached to a stationary element and said second member being fixedly attached to said elongated rotatable member, said rotatable member comprises an elongated substantially cylindrical member having at least one convoluted spiral formed the entire length thereof to cooperatively form a fluid channel with the periphery of said housing channel, whereby fluid forced through said convoluted spiral continuously rotates said elongated rotatable member.

2. The fluid jet device of claim 1 wherein said coupling means further includes a mounting means comprising a mounting flange having mounting housing pivotally disposed therein, said coupling means operatively coupled to said mounting means to permit manual pivoting of said fluid jet device.

3. The fluid jet device of claim 1 wherein said outer housing and said elongated member are affixed relative to one another, said outer housing further including a discharge orifice formed on the outer portion thereof, the axis of said discharge orifice being offset relative to the longitudinal axis of said outer housing to generate a rotating force to rotate said fluid jet device.

* * * * *